United States Patent [19]

Gelman et al.

[11] 4,144,438

[45] Mar. 13, 1979

[54] MICROWAVE ENERGY MODERATING BAG

[75] Inventors: Stephanie S. Gelman; Edward J. Maguire, Jr.; Haydee R. Guilloty, all of Cincinnati, Ohio

[73] Assignee: The Procter & Gamble Company, Cincinnati, Ohio

[21] Appl. No.: 837,073

[22] Filed: Sep. 28, 1977

[51] Int. Cl.[2] ..... H05B 9/06; B65D 85/00

[52] U.S. Cl. ..... 219/10.55 E; 99/DIG. 14; 126/390; 220/450; 229/3.5 MF; 426/107

[58] Field of Search ..... 219/10.55 E, 10.55 F, 219/10.55 R, 10.55 M; 426/107, 241, 243; 229/3.5 MF; 99/451, DIG. 14; 220/450; 126/390

[56] References Cited

U.S. PATENT DOCUMENTS

| | | | |
|---|---|---|---|
| 3,269,639 | 8/1966 | Cash | 229/3.5 MF X |
| 3,353,968 | 11/1967 | Krajewski | 219/10.55 E X |
| 3,410,700 | 11/1968 | Gstohl | 426/107 |
| 3,490,580 | 1/1970 | Brumfield et al. | 219/10.55 E X |
| 3,551,090 | 12/1970 | Brumfield et al. | 219/10.55 E |
| 3,615,711 | 10/1971 | Markus et al. | 426/107 X |
| 3,615,713 | 10/1971 | Stevenson | 219/10.55 E X |
| 3,851,574 | 12/1974 | Katz | 426/107 |
| 3,865,301 | 2/1975 | Pothier et al. | 219/10.55 E X |
| 4,015,085 | 3/1977 | Woods | 219/10.55 E |
| 4,038,425 | 7/1977 | Brandberg et al. | 426/107 |

*Primary Examiner*—Arthur T. Grimley
*Attorney, Agent, or Firm*—Thomas J. Slone; John V. Gorman; Richard C. Witte

[57] ABSTRACT

An improved microwave energy moderating bag for enclosing, for instance, foodstuff such as a beef roast to be cooked at relatively high power in a microwave oven so that the foodstuff can be uniformly cooked to a predetermined degree of doneness without being repositioned and without having to vary the power level during the cooking interval. The improved bag is of the type fabricated from a laminated sheet comprising two laminae of thermoplastic films and a perforated foil lamina of microwave reflective material such as, for example, aluminum foil. The improved bag comprises an improved pouch-type top closure and duplex side seams. Both static and dynamic embodiments of the invention are disclosed: a static embodiment being dimensionally stable as opposed to a dynamic embodiment which is heat shrinkable by virtue of comprising a heat shrinkable thermoplastic film. Such a dynamic embodiment is so constructed that it transitions from being substantially transparent to microwave energy to being substantially less transparent to microwave energy as its temperature is increased: for instance, during a cooking cycle in a microwave oven.

11 Claims, 8 Drawing Figures

MICROWAVE ENERGY MODERATING BAG

FIELD OF THE INVENTION

The present invention generally pertains to providing a bag for enclosing foodstuff such as a beef roast to be cooked in a microwave oven and which bag will sufficiently moderate and/or attenuate the microwave energy in the oven to provide a high degree of doneness uniformity to the foodstuff. More specifically, the present invention provides an improved microwave energy moderating cooking bag having an improved closure and improved side seams.

BACKGROUND OF THE INVENTION

A microwave energy moderating bag is disclosed and claimed in continuation-in-part application Ser. No. 837,074, now abandoned which was concurrently filed with the present application on Sept. 28, 1977, and which is hereby incorporated by reference. Such a bag comprises a foil such as aluminum foil which foil may, under some circumstances, precipitate spontaneous electrical arcing when disposed in a microwave energy field. An exemplary embodiment of such a bag is shown in FIG. 14 of the continuation-in-part application to have a longitudinally extending medial seam 60, a bottom seam 61, and a tab-type, adhesive-securable, top closure means 75. Briefly, as compared to that bag construction, the present invention is a microwave energy moderating bag comprising improved side seams, and an improved top closure which are so configured that such spontaneous electrical arcing as described above is substantially obviated.

SUMMARY OF THE INVENTION

In accordance with one aspect of the present invention, an improved microwave energy moderating bag of the type comprising a U-folded laminate comprising a perforate electrically conductive foil which is disposed between thermoplastic film laminae is provided which has relatively high capacitance, duplex side seams. Each duplex side seam comprises an outboard seam wherein the thermoplastic laminae are sealed together adjacent a side edge of the foil, and an inboard seam wherein the thermoplastic laminae are sealed together along a line extending through a plurality of apertures which are disposed adjacent the side edge of the foil. The improved microwave energy moderating bag may further comprise a reversible pouch-type top closure, and have the top corners of the foil lamina rounded to obviate bunching foil in the top corners of the bag when the pouch-type top closure is operated from its OPEN position to its CLOSED position.

DESCRIPTION OF THE PREFERRED EMBODIMENTS

Figure 1:
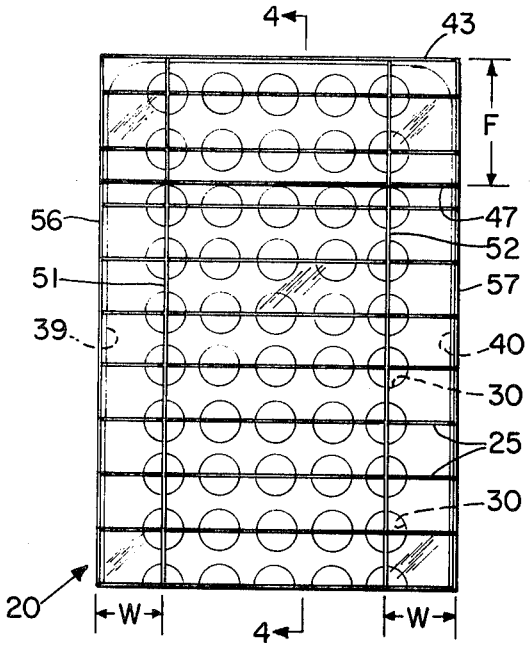
FIG. 1 is a plan view of a microwave energy moderating bag embodiment of the present invention.
Figure 2:
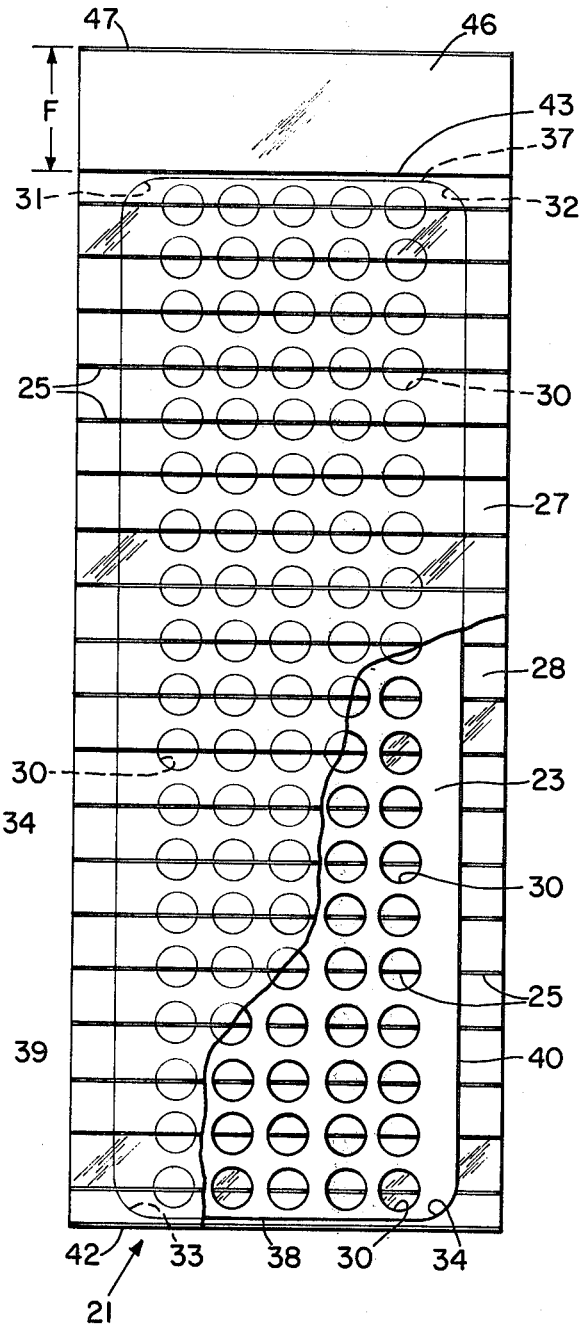
FIG. 2 is a partially torn away plan view of a laminated sheet from which the bag shown in FIG. 1 can be fabricated.

A laminated, microwave energy moderating bag 20 is shown in FIG. 1 which is fabricated from a laminated sheet 21, FIG. 2. Sheet 21, FIG. 2, comprises a perforate foil lamina 23 of microwave reflective material which is secured by lines 25 of bar-type heat seals intermediate two substantially microwave transparent film laminae 27 and 28 of thermoplastic material.

Briefly, the foil lamina 23 is substantially fully perforated (except for an imperforate border) by an array of apertures 30 which are sufficiently large and numerous to render the bag 20 substantially transparent to microwave energy of a predetermined frequency but which apertures are sufficiently small that such microwave energy which passes into the bag in a microwave oven will be sufficiently moderated to precipitate uniform cooking of a foodstuff such as a beef roast disposed therein. As will be fully described hereinafter, bag 20 comprises relatively high capacitance, duplex side seams and low-bulk top corners which substantially obviate arcing when the bag is closed and disposed in a microwave energy field as for instance in a microwave oven.

The foil lamina 23 of sheet 21, FIG. 2, is preferably aluminum foil and is provided with a five column, nineteen row array of apertures 30. Also, the corners 31 through 34 of foil lamina 23 are rounded to provide low-bulk top corners in bag 20. The top and bottom edges of the foil lamina 23 are designated 37 and 38, respectively, and its left side and right side edges are designated 39 and 40, respectively.

The film laminae 27 and 28, FIG. 2, are sufficiently longer than the foil lamina 23 to enable hot-wire cutting and sealing the laminae 27 and 28 directly together to form a transverse seam 42 adjacent the bottom edge 38 of the foil lamina 23; to enable hot bar sealing the laminae 27 and 28 directly together to form another transverse seam 43 adjacent the top edge 37 of the foil lamina 23; and to provide a two-ply pouch-forming closure flap 46 having a length F and which flap has its distal edge 47 hot-wire sealed. A hot-wire cutter and sealer which is suitable for cutting and sealing seam 42 and for sealing edge 47 is manufactured by Weldotron Corporation, 1532 S. Washington Avenue, Piscataway, New Jersey 08854 and is known as the Weldotron "L" -Sealed 6302.

Still referring to FIG. 2, the lines 25 of bar-type heat seals are disposed horizontally across the laminated sheet 21. One line 25 of heat seal is provided for each row of apertures 30. Where the lines 25 of heat seals pass across the apertures 30, the film laminae 27 and 28 are bonded directly together and, where the lines 25 pass across the unperforated areas of the foil lamina 23, the film laminae 27 and 28 are bonded to the foil lamina 23.

An exemplary, dynamic embodiment of bag 20, FIG. 1, comprises a laminated sheet 21, FIG. 2, wherein the foil lamina 23 is aluminum foil having a nominal thickness of about seven ten-thousandths of an inch (0.0007 inch); the corners 31 through 34 of the foil lamina 23 are rounded to provide low-bulk top corners in bag 20; and the film laminae 27 and 28 are biaxially oriented, sixty gauge polyethylene having a nominal heat shrink capacity of about forty percent. The apertures 30 of this exemplary embodiment are initially about one inch in diameter but are reduced slightly by shrinkage which is precipitated by forming the lines 25 of bar-type heat seals with a bar sealer such as an Audion Super Seal Master Model 5805A. This bar sealer is manufactured by Audion Electkro, Amsterdam, Holland and is available in the United States through Packing Aids Corporation, 469 Bryant Street, P.O. Box 77203, San Francisco, Calif. As shown in FIG. 2, the array of apertures in the foil lamina comprises nineteen (19) rows of five (5) apertures each which are disposed to form five (5) columns. In another exemplary embodiment of the invention of the type shown in FIGS. 1 through 3, the array of apertures comprises nineteen (19) rows of apertures which are disposed to form eleven (11) columns.

The above description of an exemplary dynamic embodiment of the present invention is not intended to limit such embodiments to either biaxially oriented polyethylene or to constructions wherein both thermoplastic laminae are heat shrinkable. Indeed, the hereinbefore referenced and incorporated continuation-in-part application discloses dynamic constructions wherein only one heat shrinkable lamina is employed.

An exemplary static embodiment of bag 20, FIG. 1, for use in microwave ovens wherein the nominal frequency is 2.45 GHz comprises the same construction as the exemplary dynamic embodiment described above except: whereas the dynamic embodiment comprises heat shrinkable, biaxially oriented polyethylene the static embodiment comprises nominally unoriented polyethylene; and whereas the preferred diameter of apertures 30 in the dynamic embodiment is about one inch, the preferred diameter of apertures 30 in the static embodiments is about three-quarters of one inch.

Figure 3:
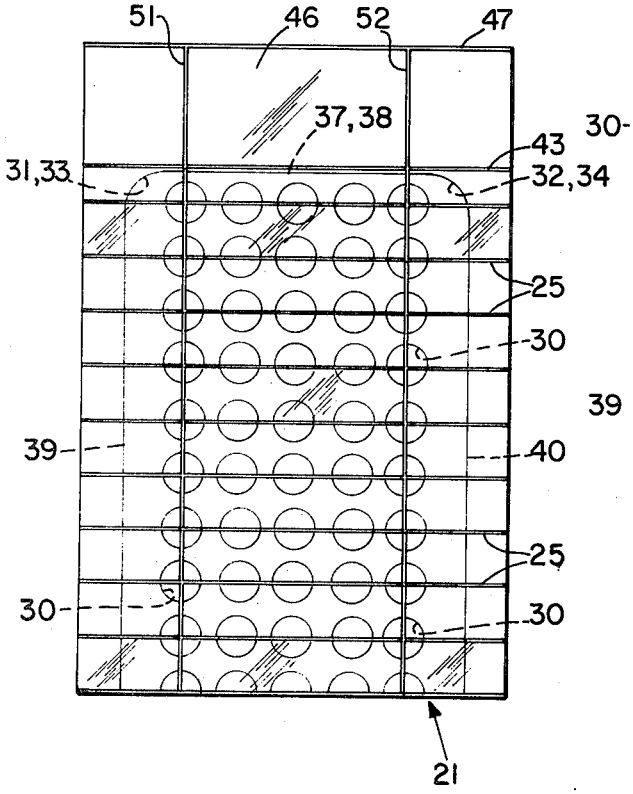
FIG. 3 is a plan view showing the laminated sheet of FIG. 2 after it has been U-folded and provided with two longitudinally extending inboard side seams.

FIG. 3 shows the laminated sheet 21 of FIG. 2 after it has been U-folded about the horizontal centerline of the foil lamina 23 so that the bottom corners 33 and 34 of the foil lamina 23 overlie the top corners 31 and 32 of the foil lamina 23, and so that the bottom edge 38 of the foil lamina 23 is juxtaposed its top edge 37. Also, as shown in FIG. 3, the sheet 21 is secured in the U-folded shape by longitudinally extending lines 51 and 52 of bar-type heat seals which are designated the left inboard side seam 51 and the right inboard side seam 52. The seams 51 and 52 extend longitudinally across the left-most and the right-most columns of apertures 30.

Figure 4:
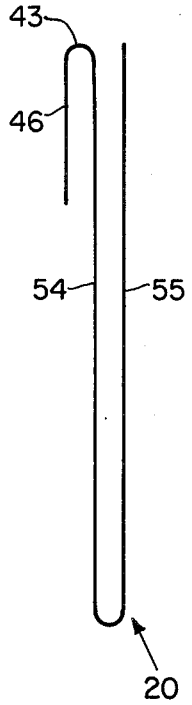
FIG. 4 is a somewhat schematic sectional view taken along line 4—4 of FIG. 1 and which shows the top closure of the bag in its OPEN position.
Figure 5:
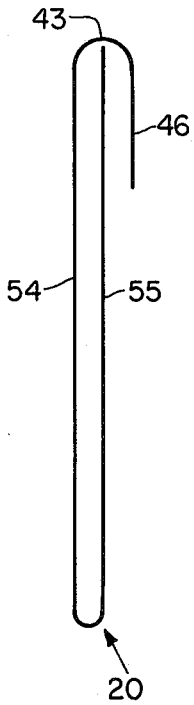
FIG. 5 is a somewhat schematic sectional view similar to FIG. 4 which view shows the top closure of the bag after it has been operated to its CLOSED position.
Figure 6:
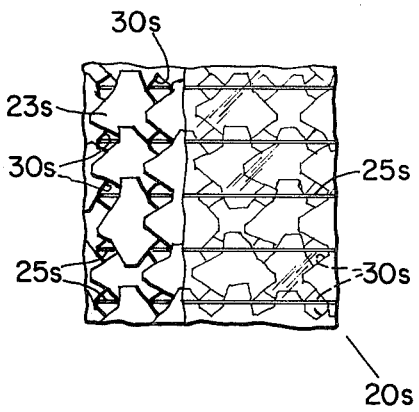
FIG. 6 is a fragmentary, partially torn away plan view of a bag such as shown in FIG. 1 which comprises heat shrinkable laminae and which has been shrunken by heat.

The U-folded and side-seamed sheet 21 shown in FIG. 3 is converted into the finished bag 20, FIG. 1, by reverse folding the flap 46 along seam 43 so that the flap 46 extends downwardly along the outside surface of the back wall 54 of the bag as indicated in FIG. 4. Also, the front wall of the bag is designated 55 in FIGS. 4 and 5. Still further, with respect to FIGS. 4 and 5, the plys of the laminated material are not shown because to do so would require unduly increasing the relative thicknesses of the laminae, and would grossly distort the figures. The excess side edge portions of the thermoplastic laminae 27 and 28 are then removed and the finished side edges 56 and 57 of the bag are sealed adjacent to but outboard from the side edges 39 and 40 of the foil lamina by a hot-wire cutter and sealer as described hereinbefore. The side edges 56 and 57 are alternatively designated the left outboard side seam 56 and the right outboard side seam 57. The side edges of the flap 46 are also simultaneously heat sealed to the adjacent upper portions of the outboard side seams 56 and 57 of the bag 20. This forms the flap 46 into a self venting, reversible, pouch-type top closure which can be folded from its OPEN position, FIG. 4, to its CLOSED position as schematically indicated in FIG. 5. The rounded corners 31 through 34 of the foil lamina 23 reduce the bulk of the laminate in the top corners of the bag so that closure of the bag can be easily accomplished. Also, the rounded corners lessen the tendency for such a laminated bag structure to arc in microwave energy fields.

Referring again to FIG. 1, the combination of the left inboard seam 51 and the left outboard seam 56, and the combination of the right inboard seam 52 and the right outboard seam form duplex side seams of width W wherein the border positions of the front and back walls of the bag are closely juxtaposed. Thus, the foil components of the front and back walls form relatively high capacitance structures as compared to what their capacitances would be if the foil components were not closely juxtaposed. These duplex side seam structures substantially reduce the tendency to precipitate arcs in microwave energy fields as compared to having the side edges joined together only along the side edges 56 and 57. That is, without the inboard side seam, the bag structure would under some unusually high intensity microwave field conditions such as in a virtually unloaded microwave oven, have a greater tendency to arc along its side seams.

FIG. 5 shows a fragmentary portion of a dynamic embodiment of a bag 20, FIG. 1, after it has been shrunken by elevating its temperature. The respective designators used in FIG. 5 are the same as used in FIG. 1 except for having a suffix "s." Such shrinkage induces crumpling and/or folding of the foil lamina of the bag in such a manner that the effective size of apertures 30 is substantially reduced. This, in turn, precipitates a substantial reduction in the transmissibility of microwave energy through the apertures and, by selecting a heat shrinkable thermoplastic which will shrink during a microwave cooking event, overcooking will be substantially obviated. Clysar (registered trademark of DuPont Company) 60EH-F is such a biaxially oriented thermoplastic (polyethylene) which is particularly well suited to timely shrink during the microwave cooking of beef roasts.

Figure 7:
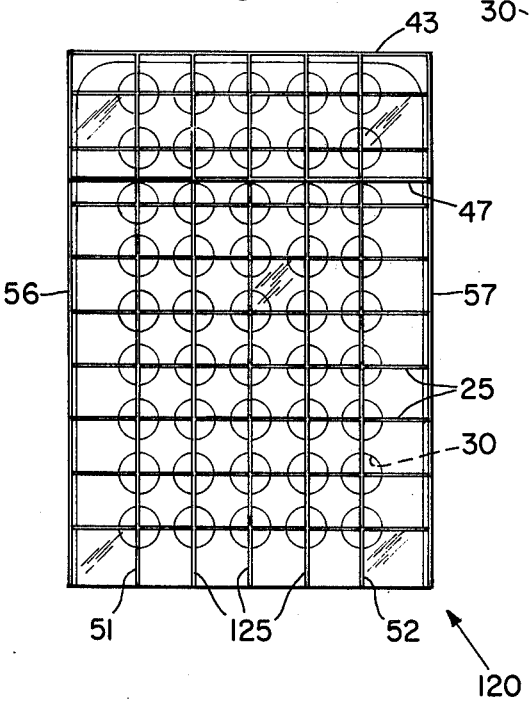
FIG. 7 is a plan view of an alternate embodiment of the present invention.

Bag 120, FIG. 7, is an alternate embodiment of the present invention which is identical in all respects to the hereinbefore described bag 20, FIGS. 1 through 6, except for the omission of the center row of apertures 30 in the foil lamina 23 as shown in FIG. 2, and except for having an additional longitudinal bar-type heat seal 125 through each column of apertures 30 intermediate the left-most and the right-most columns. Note however that bar seals 125 are made prior to U-folding the sheet so that the front wall is not thereby bonded to the bag wall of the finished bag 120. Thus, whereas the center row of apertures 30 appear as half-circles in FIGS. 1 and 3, that zone (the bottom) of bag 120 is imperforate.

Figure 8:
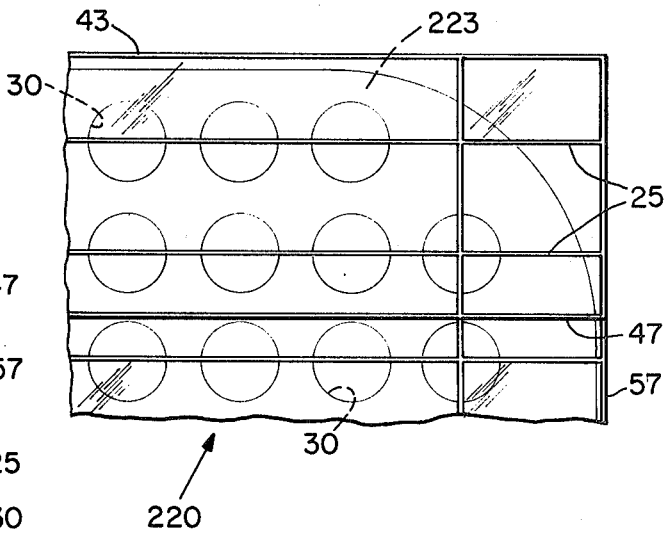
FIG. 8 is an enlarged scale, fragmentary plan view of a top corner portion of another alternate embodiment of the present invention.

Bag 220, a fragmentary top corner portion of which is shown in enlarged scale in FIG. 8, is another embodiment of the present invention which is identical to bag 20, FIGS. 1 through 6, except for the omission of an aperture 30 in each of the rounded corners of the foil lamina. This enables greater rounding of the top corners of the foil lamina to further obviate bunching of the foil when the closure of the bag is operated from its OPEN to its CLOSED position; reference FIGS. 4 and 5. The foil lamina of bag 220 is designated 223 in FIG. 8 and the other features are identified by the designators assigned to the corresponding members and features of bag 20, FIGS. 1 through 6.

While several embodiments of the present invention have been described herein, many other modifications of the present invention may be devised and used. Therefore, it is not intended to hereby limit the present invention to the embodiments shown and/or described. The terms used in describing the invention are used in their descriptive sense and not as terms of limitation, it being intended that all of the equivalents thereof be included within the scope of the appended claims.

What is claimed is:

1. A microwave energy moderating bag comprising a laminated sheet of material having a perforate, electrically conductive foil lamina disposed intermediate and secured by lines of bonding between two laminae of substantially microwave transparent films of material having a relatively high dielectric constant, said sheet being U-folded and provided with relatively high capacitance duplex side seams, said bag further comprising an open top end and means for said top end to be closed sufficiently to substantially obviate the passage of microwave energy of a predetermined frequency therethrough.

2. The bag of claim 1 wherein said means comprises a self venting, pouch-type closure disposed adjacent its top end and which closure is operable from an OPEN position to a CLOSED position, and wherein the corners of said foil are sufficiently rounded to substantially obviate bunching of said foil in the top corners of said bag when said closure is operated from said OPEN to said CLOSED position.

3. The bag of claim 1 wherein said films comprise food approved thermoplastic material.

4. The bag of claim 3 wherein at least one of said films is a heat shrinkable thermoplastic material.

5. The bag of claim 4 wherein said thermoplastic material is biaxially oriented polyethylene.

6. The bag of claim 5 wherein said means comprises a self venting, pouch-type closure disposed adjacent its top end and which closure is operable from an OPEN position to a CLOSED position, and wherein the corners of said foil are sufficiently rounded to substantially obviate bunching of said foil in the top corners of said bag when said closure is operated from said OPEN to said CLOSED position.

7. The bag of claim 1 wherein each duplex side seam comprises an outboard side seam wherein the side edges of the films are sealed together outboard from the adjacent side edge of said foil, and an inboard side seam which extends generally parallel to said outboard side seam and across a plurality of apertures in said perforate foil which apertures are spaced from the side edge of said foil.

8. The bag of claim 7 wherein said means comprises a self venting, pouch-type closure disposed adjacent its top end and which closure is operable from an OPEN position to a CLOSED position, and wherein the corners of said foil are sufficiently rounded to substantially obviate bunching of said foil in the top corners of said bag when said closure is operated from said OPEN to said CLOSED position.

9. The bag of claim 8 wherein said films comprise food approved thermoplastic material.

10. The bag of claim 9 wherein at least one of said films is a heat shrinkable thermoplastic material.

11. The bag of claim 10 wherein said thermoplastic material is biaxially oriented polyethylene.

* * * * *